US005438623A

United States Patent [19]

Begault

[11] Patent Number: 5,438,623

[45] Date of Patent: Aug. 1, 1995

[54] MULTI-CHANNEL SPATIALIZATION SYSTEM FOR AUDIO SIGNALS

[75] Inventor: Durand R. Begault, San Francisco, Calif.

[73] Assignee: The United States of America as represented by the Administrator of National Aeronautics and Space Administration, Washington, D.C.

[21] Appl. No.: 130,948

[22] Filed: Oct. 4, 1993

[51] Int. Cl.[6] ..... H04S 1/00

[52] U.S. Cl. ..... 381/17; 381/25

[58] Field of Search ..... 381/1, 17, 25, 24, 26, 381/63

[56] References Cited

U.S. PATENT DOCUMENTS

| | | | |
|---|---|---|---|
| 4,087,629 | 5/1978 | Atoji et al. | 387/25 |
| 4,219,696 | 8/1980 | Kogure et al. | 179/1 G |
| 4,251,688 | 2/1981 | Furner | 179/16 Q |
| 4,638,506 | 1/1987 | Han | 381/34 |
| 4,731,848 | 3/1988 | Kendall et al. | 381/63 |
| 4,774,515 | 9/1988 | Gehring | 342/53 |
| 4,817,149 | 3/1989 | Myers | 381/1 |
| 4,856,064 | 8/1989 | Iwamatsu | 381/1 |
| 4,908,858 | 3/1990 | Ohno | 381/1 |
| 5,023,913 | 6/1991 | Matsumoto et al. | 381/63 |
| 5,027,687 | 7/1991 | Iwamatsu | 84/600 |
| 5,046,097 | 9/1991 | Lowe et al. | 381/17 |
| 5,105,462 | 4/1992 | Lowe et al. | 381/17 |
| 5,146,507 | 9/1992 | Satoh et al. | 381/103 |
| 5,173,944 | 12/1992 | Begault | 381/17 |
| 5,187,692 | 2/1993 | Haneda et al. | 381/17 |
| 5,208,860 | 5/1993 | Lowe et al. | 381/17 |
| 5,333,200 | 7/1994 | Cooper et al. | 381/25 |

OTHER PUBLICATIONS

"Spatial Hearing: the psychophysics of human sound localization" MIT Press, Cambridge, 1983–Jens Blauert.

"Technical Aspects of a Demonstration Tape for Three-Dimensional Sound Displays" (TM 102826), NASA-Ames Research Center, 1960 by D. R. Begault et al.

"Equalization and Spatial Equalization of Dummy Head Recordings or Loudspeaker Reproduction", *Journal of Audio Engineering Society,* 37 (1-2), 20-29–D. Griesinger, 1989.

"Extending the Notion of a Window System To Audio", *Computer,* 23 (8) 66-72 (1990)–L. F. Ludwig et al. (1990).

"Techniques and Applications For Binaural Sound Manipulation in Human-Machine Interfaces" (TM102279), NASA-Ames Research Center D. R. Begault et al. (1990).

"A System for Three-Dimensional Acoustic Visualization in a Virtual Environment Work Station", *Visualization '90, IEEE Computer Society Press,* San Francisco, Calif. (pp. 329-337)–E. M. Wenzel et al. (1990).

"Call sign intelligibility improvement using a spatial auditory display" (Technical Memorandium No. 104014), NASA Ames Research Center, D. R. Begault (1983).

"FIR Linear Phase Filter Design Program", *Programs For Digital Signal Processing,* (pp. 5-1-1-5.1-13), New York: IEEE Press–J. H. McClelland et al. (1979).

"Perceptual similarity of measured and synthetic HRTF filtered speech stimuli", *Journal of the Acoustical Society of America,* (1992) 92(4), 2334–D. R. Begault.

*Primary Examiner*—Stephen Brinich

*Attorney, Agent; or Firm*—Kenneth L. Warsh; Guy Miller; John R. Manning

[57] ABSTRACT

Synthetic head related transfer functions (HRTFs) for imposing reprogrammable spatial cues to a plurality of audio input signals included, for example, in multiple narrow-band audio communications signals received simultaneously are generated and stored in interchangeable programmable read only memories (PROMs) which store both head related transfer function impulse response data and source positional information for a plurality of desired virtual source locations. The analog inputs of the audio signals are filtered and converted to digital signals from which synthetic head related transfer functions are generated in the form of linear phase finite impulse response filters. The outputs of the impulse response filters are subsequently reconverted to analog signals, filtered, mixed and fed to a pair of headphones.

20 Claims, 4 Drawing Sheets

MULTI-CHANNEL SPATIALIZATION SYSTEM FOR AUDIO SIGNALS

ORIGIN OF THE INVENTION

The invention described herein was made in the performance of work under a NASA contract and is subject to Public Law 96-517 (35 U.S.C. 200 et seq.) The contractor has assigned his rights thereunder to the Government.

BACKGROUND OF THE INVENTION

1. Field of the Invention

The invention relates generally to the field of three dimensional audio technology and more particularly to the use of head related transfer functions (HRTF) for separating and imposing spatial cues to a plurality of audio signals in order to generate local virtual sources thereof such that each incoming signal is heard at a different location about the head of a listener.

2. Description of the Prior Art

Three dimensional or simply 3-D audio technology is a generic term associated with a number of new systems that have recently made the transition from the laboratory to the commercial audio world. Many of the terms have been used both commercially and technically to describe this technique, such as, dummy head synthesis, spatial sound processing, etc. All these techniques are related in their desired result of providing a psychoacoustically enhanced auditory display.

Much in the same way that stereophonic and quadraphonic signal processing devices have been introduced in the past as improvements over their immediate predecessors, 3-D audio technology can be considered as the most recent innovation for both mixing consoles and reverberation devices.

Three dimensional audio technology utilizes the concept of digital filtering based on head related transfer functions (HRTF). The role of the HRTF was first summarized by Jens Blauert in "Spatial Hearing: the psychophysics of human sound localization" MIT Press, Cambridge, 1983. This publication noted that the pinnae of the human ears are shaped to provide a transfer function for received audio signals and thus have a characteristic frequency and phase response for a given angle of incidence of a source to a listener. This characteristic response is convolved with sound that enters the ear and contributes substantially to our ability to listen spatially.

Accordingly, this spectral modification imposed by an HRTF on an incoming sound has been established as an important cue for auditoryspatial perception, along with interaural level and amplitude differences. The HRTF imposes a unique frequency response for a given sound source position outside of the head, which can be measured by recording the impulse response in or at the entrance of the ear canal and then examining its frequency response via Fourier analysis. This binaural impulse response can be digitally implemented in a 3-D audio system by convolving the input signal in the time domain with the impulse response of two HRTFs, one for each ear, using two finite impulse response filters. This concept was taught, for example, in 1990 by D. R. Begault et al in "Technical Aspects of a Demonstration Tape for Three-Dimensional Sound Displays" (TM 102826), NASA—Ames Research Center and also in U.S. Pat. No. 5,173,944, "Head Related Transfer Function Pseudo-Stereophony", D. R. Begault, Dec. 22, 1992.

The primary application of 3-D sound, however, has been made towards the field of entertainment and not towards improving audio communications systems involving intelligibility of multiple streams of speech in a noisy environment. Thus the focus of recent research and development for 3-D audio technology has centered on either commercial music recording, playback and playback enhancement techniques or on utilizing the technology in advanced human-machine interfaces such as computer work stations, aeronautics and virtual reality systems. The following cited literature is typically illustrative of such developments: D. Griesinger, (1989), "Equalization and Spatial Equalization of Dummy Head Recordings or Loudspeaker Reproduction", *Journal of Audio Engineering Society,* 37 (1–2), 20–29; L. F. Ludwig et al (1990), "Extending the Notion of a Window System To Audio", *Computer,* 23 (8), 66–72; D. R. Begault et al (1990), "Techniques and Application For Binaural Sound Manipulation in Human-Machine Interfaces" (TM102279), *NASA-Ames Research Center*; and E. M. Wenzel et al (1990), "A System for Three-Dimensional Acoustic Visualization in a Virtual Environment Work Station", *Visualization* '90, *IEEE Computer Society Press*, San Francisco, Calif. (pp. 329–337).

The following patented art is also directed to 3-D audio technology and is worthy of note: U.S. Pat. No. 4,817,149, "Three Dimensional Auditory Display Apparatus And Method Utilizing Enhanced Bionic Emulation Of Human Binaural Sound Localization", Peter H. Meyers, Mar. 28, 1989; U.S. Pat. No. 4,856,064, "Sound Field Control Apparatus", M. Iwamatsu, Aug. 8, 1989; and U.S. Pat. No. 4,774,515, "Attitude Indicator", B. Gehring, Sep. 27, 1988. The systems disclosed in these references simulate virtual source positions for audio inputs either with speakers, e.g. U.S. Pat. No. 4,856,064 or with headphones connected to magnetic tracking devices, e.g. U.S. Pat. No. 4,774,515 such that the virtual position of the auditory source is independent of head movement.

SUMMARY

Accordingly, it is an object of the invention to provide a method and apparatus for producing three dimensional audio signals.

And it is another object of the invention is to provide a method and apparatus for deriving synthetic head related transfer functions for imposing spatial cues to a plurality of audio inputs in order to generate virtual sources thereof.

It is a further object of the invention to provide a method and apparatus for producing three dimensional audio signals which appear to come from separate and discrete positions from about the head of a listener.

It is still yet another object to separate multiple audio signal streams into discrete selectively changeable external spatial locations about the head of a listener.

And still yet a further object of the invention is to reprogrammably distribute simultaneous incoming audio signals at different locations about the head of a listener wearing headphones.

The foregoing and other objects are achieved by generating synthetic head related transfer functions (HRTFs) for imposing reprogrammable spatial cues to a plurality of audio input signals received simultaneously by the use of interchangeable programmable read only memories (PROMs) which store both head related transfer function impulse response data and source positional information for a plurality of desired virtual source locations. The analog inputs of the audio signals are filtered and converted to digital signals from which synthetic head related transfer functions are generated in the form of linear phase finite impulse response filters. The outputs of the impulse response filters are subsequently reconverted to analog signals, filtered, mixed and fed to a pair of headphones. Another aspect of the invention is employing a simplified method for generating the synthetic HRTFs so as to minimize the quantity of data necessary for HRTF generation.

BRIEF DESCRIPTION OF THE DRAWINGS

The following detailed description of the invention will be more readily understood when considered together with the accompanying drawings wherein.

DETAILED DESCRIPTION OF THE INVENTION

Figure 1:
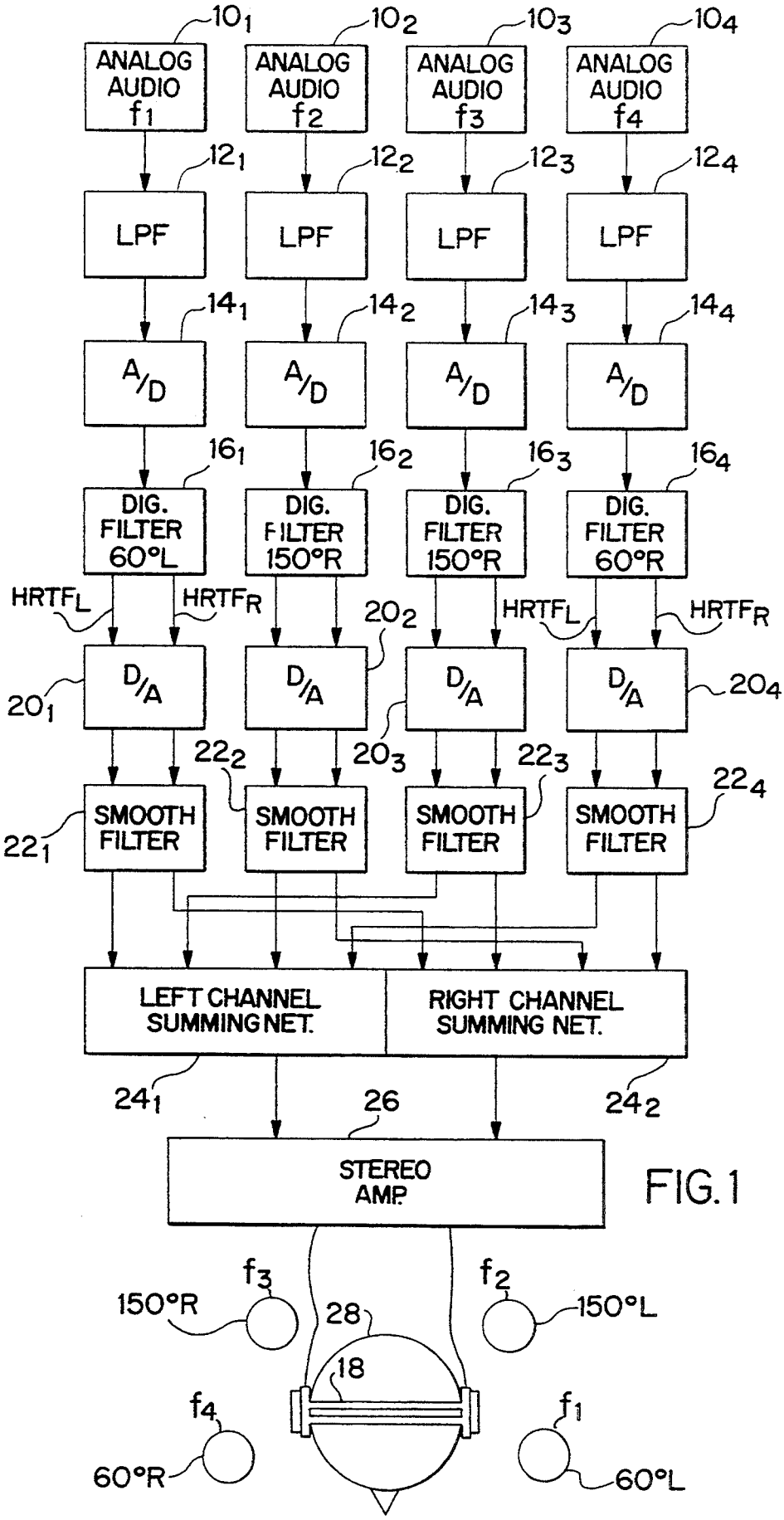
FIG. 1 is an electrical block diagram illustrative of the preferred embodiment of the invention.

Referring now to the drawings and more particularly to FIG. 1, shown thereat is an electronic block diagram generally illustrative of the preferred embodiment of the invention. As shown, reference numerals $\mathbf{10}_1$, $\mathbf{10}_2$, $\mathbf{10}_3$ and $\mathbf{10}_4$ represent discrete simultaneous analog audio outputs of a unitary device or a plurality of separate devices capable of receiving four separate audio signals, for example, four different radio communications channel frequencies $f_1$, $f_2$, $f_3$ and $f_4$. Such apparatus is well known and includes, for example, the operational intercom system (OIS) used for space shuttle launch communications at the NASA Kennedy Space Center. Although radio speech communications is illustrated herein for purposes of illustration, it should be noted that this invention is not meant to be limited thereto, but is applicable to other types of electrical communications systems as well, typical examples being wire and optical communications systems.

Each of the individual analog audio inputs is fed to respective lowpass filters $\mathbf{12}_1$, $\mathbf{12}_2$, $\mathbf{12}_3$, and $\mathbf{12}_4$ whose outputs are fed to individual analog to digital (A/D) converters $\mathbf{14}_1$, $\mathbf{14}_2$, $\mathbf{14}_3$, and $\mathbf{14}_4$. Such apparatus is also well known to those skilled in the art.

Figure 5A:
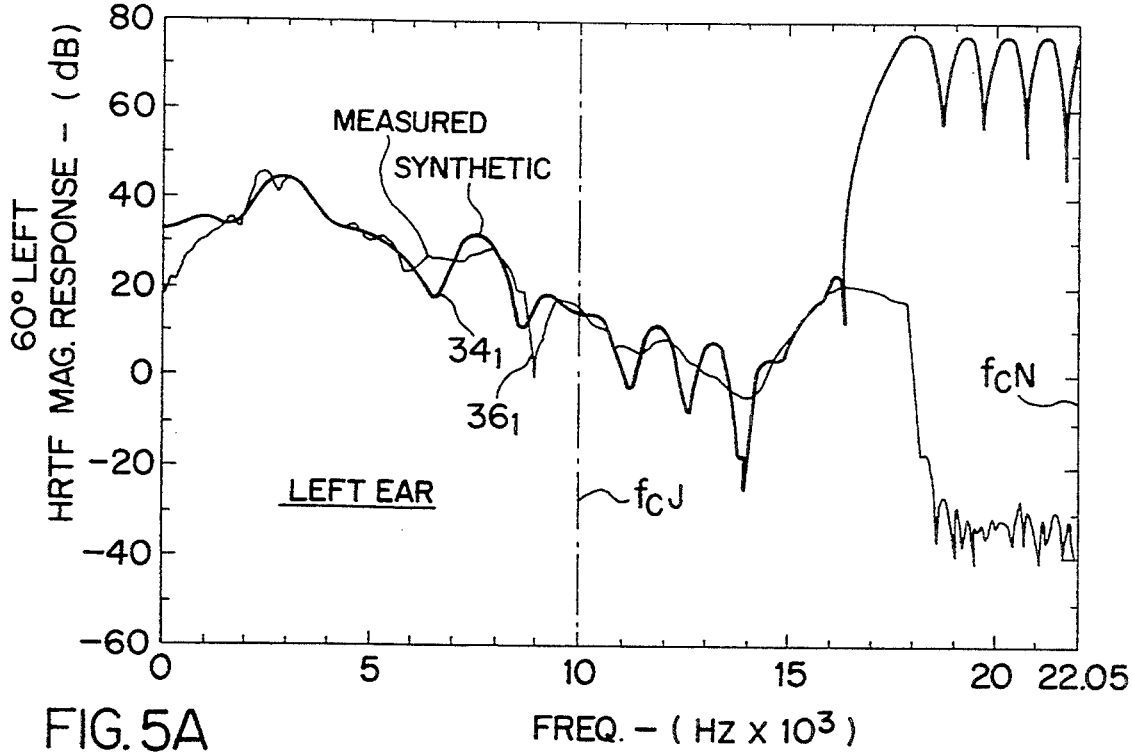
FIGS. 5A and 5B are a set of characteristic curves illustrative of both measured and synthetically derived HRTF magnitude responses for the left and right ear as a function of frequency.
Figure 5B:
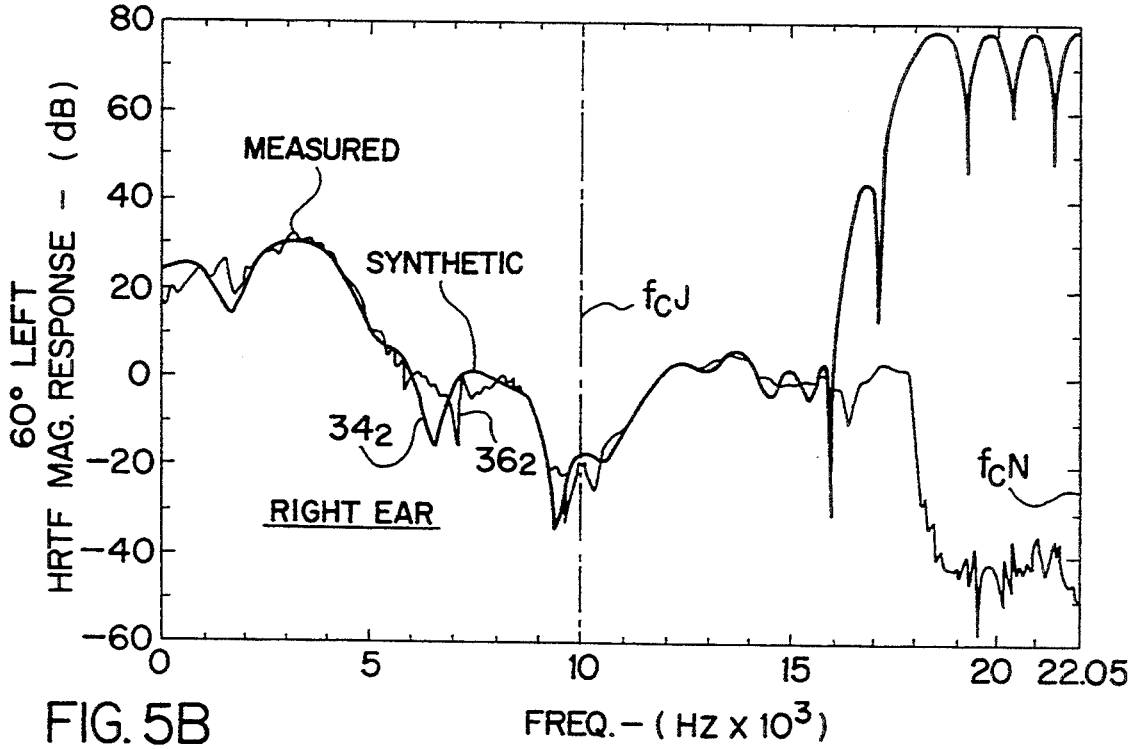

Conventionally, the cutoff frequency $f_c$ of the lowpass filters is set so that the stopband frequency is at one half or slightly below one half the sampling rate, the Nyquist rate $f_cN$ of the analog to digital converters $\mathbf{14}_1$ . . . $\mathbf{14}_4$. Typically, the filter is designed so that the passband is as close to $f_cN$ as possible. In the present invention, however, another stopband frequency $f_cJ$ is utilized and is shown in FIGS. 5A and 5B. $F_cJ$ is specifically chosen to be much lower than $f_cN$. Further, $f_cJ$ is set to the maximum usable frequency for speech communication and is therefore set at 10 kHz, although it can be set as low as 4 kHz depending upon the maximum frequency obtainable from audio signal devices $\mathbf{10}_1$, $\mathbf{10}_2$, $\mathbf{10}_3$ and $\mathbf{10}_4$.

In FIG. 1, the lowpass filters $\mathbf{12}_1$, $\mathbf{12}_2$, $\mathbf{12}_3$ and $\mathbf{12}_4$ have a passband up to $f_cJ$ and include a stopband attenuation of at least 60 dB at 16 kHz. It should be noted, however, that the closer the $f_cJ$ is to 16 kHz, the more expensive the filter implementation becomes and thus cost considerations may influence the design considerations. In no case, however, is $f_cJ$ chosen to be below 3.5 kHz.

Figure 2:
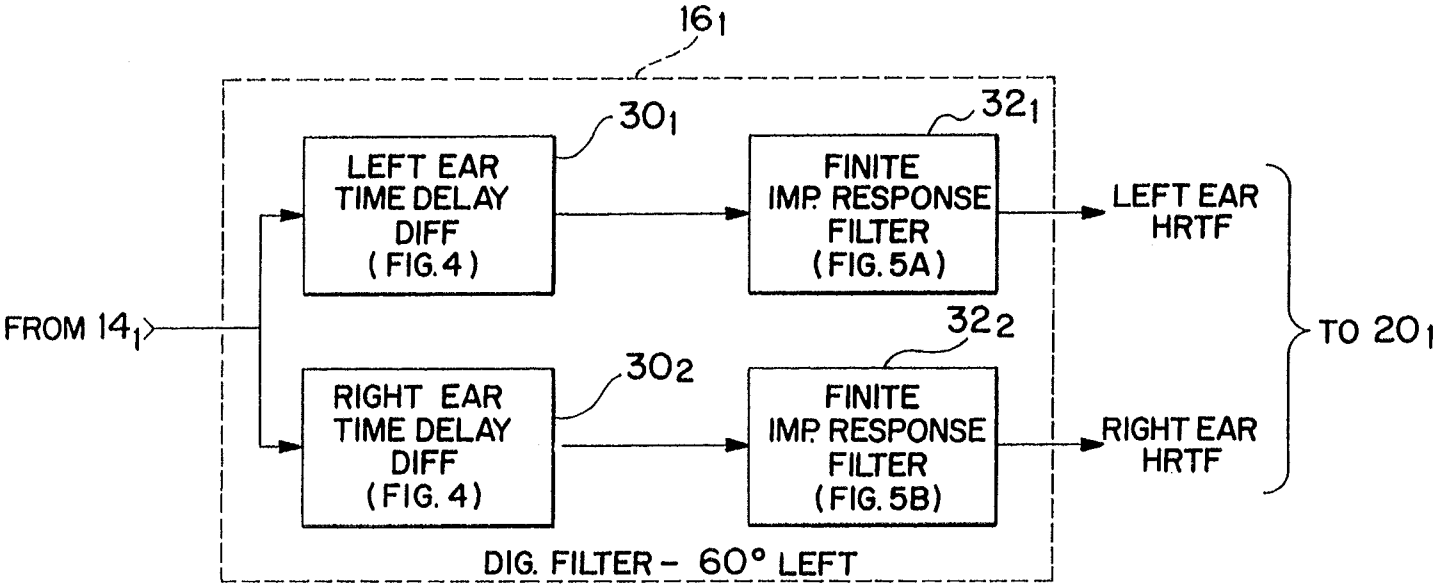
FIG. 2 is an electrical block diagram illustrative of one digital filter shown in FIG. 1 for implementing a pair of HRTFs for a desired spatial location.

Reference numerals $\mathbf{16}_1$, $\mathbf{16}_2$, $\mathbf{16}_3$ and $\mathbf{16}_4$ denote four discrete digital filters for generating pairs of synthetic head related transfer functions (HRTF), for the left and right ear from the respective outputs of the A/D converter $\mathbf{14}_1$ . . . $\mathbf{14}_4$. The details of one of the filters, $\mathbf{16}_1$, is shown in FIG. 2 and will be referred to subsequently. Each filtering operation implemented by the four filters $\mathbf{16}_1$ . . . $\mathbf{16}_4$ is designed to impart differing spatial auditory cues to each radio communication channel output, four of which are shown in FIG. 1. As shown, the cues are related to head related transfer functions measured at 0° elevation and at 60° left, 150° left, 150° right and 60° right for the audio signals received, for example, on radio carrier frequencies $f_1$, $f_2$, $f_3$, and $f_4$.

Outputted from each of the digital filters $\mathbf{16}_1$ . . . $\mathbf{16}_4$ are two synthetic digital outputs $HRTF_L$ and $HRTF_R$ for left and right ears, respectively, which are fed to two channel digital to analog converters $\mathbf{20}_1$, $\mathbf{20}_2$, $\mathbf{20}_3$ and $\mathbf{20}_4$. The outputs of each of the D/A converters is then coupled to respective low-pass smoothing filters $\mathbf{22}_1$, $\mathbf{22}_2$, $\mathbf{22}_3$, $\mathbf{22}_4$. The cut-off frequencies of the smoothing filters $\mathbf{22}_1$ . . . $\mathbf{22}_4$ can be set to either $f_cJ$ or $f_cN$, depending upon the type of devices which are selected for use.

The pair of outputs from each of the filters $\mathbf{22}_1$ . . . $\mathbf{22}_4$ are next fed to left and right channel summing networks $\mathbf{24}_1$ and $\mathbf{24}_2$ which typically consist of a well known circuit including electrical attenuations and summing points, not shown. The left and right channel outputs of the filters $\mathbf{22}_1$ . . . $\mathbf{22}_4$ are summed and scaled to provide a sound signal level below that which provides distortion.

Figure 3B:
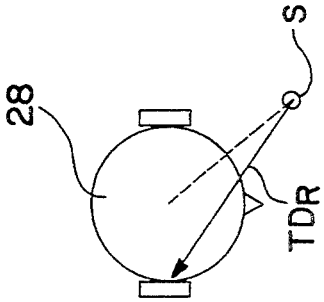
FIGS. 3A and 3B are diagrams illustrative of the time delay to the left and right ears of a listener for sound coming from a single source located to the left and in front of the listener.
Figure 3A:
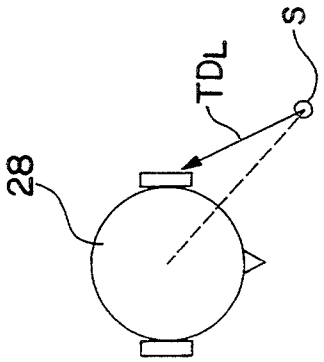

The summed left and right channel outputs from the networks $\mathbf{24}_1$ and $\mathbf{24}_2$ are next fed to a stereo headphone amplifier 26, the output of which is coupled to a pair of headphones 18. The user or listener 28 listening over the stereo headphones 18 connected to the amplifier 26 is caused to have a separate percept of the audio signals received, for example, but not limited to, by the four radio channels, as shown in FIG. 1, so that they seem to be coming from different spatial locations about the head, namely at or near left 60°, left 150°, right 150° and right 60° and at 0° elevation. Referring now to FIG. 2, shown thereat are the details of one of the digital filters, i.e. filter $\mathbf{16}_1$ shown in FIG. 1. This circuit element is used to generate a virtual sound source at 60° left as shown in FIGS. 3A and 3B. The digital filter $\mathbf{16}_1$ thus receives the single digital input from the A/D converter $\mathbf{14}_1$ where it is split into two channels, left and right, where individual left and right ear synthetic HRTFs are generated and coupled to the digital to analog converter $\mathbf{20}_1$. Each synthetic HRTF, moreover, is comprised of two parts, a time delay and an impulse response that give rise to a particular spatial location percept. Each HRTF has a unique configuration such that a different spatial image for each channel frequency $f_1 \ldots f_4$ results at a predetermined different position relative to the listener 28 when wearing the pair of headphones as shown in FIG. 1.

It is important to note that both interaural time delay and interaural magnitude of the audio signals function as primary perceptual cues to the location of sounds in space, when convolved, for example, with monaural speech or audio signal sound sources. Accordingly, the digital filter $\mathbf{16}_1$ as well as the other digital filters $\mathbf{16}_2$, $\mathbf{16}_3$ and $\mathbf{16}_4$ are comprised of digital signal processing chips, e.g. Motorola type 56001 DSPs that access interchangeable PROMs, such as type 27C64-150 EPROMs manufactured by National Semiconductor Corp. The PROMs are programmed with two types of information: (a) time delay difference information regarding the difference in time delays $TD_L$ and $TD_R$ for sound to reach the left and right ears for a desired spatial position as depicted by reference numerals $\mathbf{30}_1$ and $\mathbf{30}_2$, and (b) sets of filter coefficients used to implement finite impulse response (FIR) filtering, as depicted by reference numerals $\mathbf{32}_1$ and $\mathbf{32}_2$, over a predetermined audio frequency range to provide suitable frequency magnitude shaping for left and right channel synthetic HRTF outputs.

Figure 4:
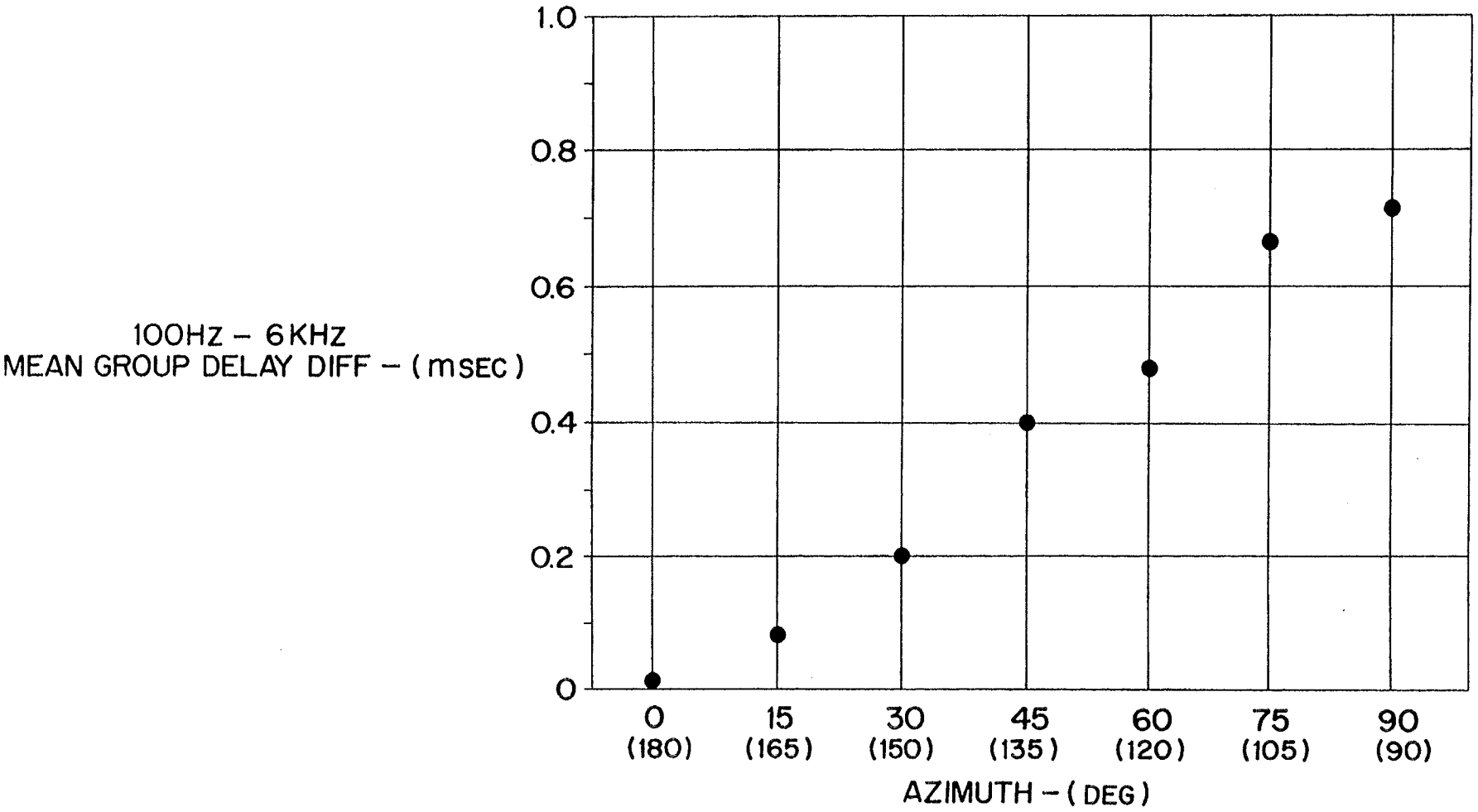
FIG. 4 is a graph illustrative of mean group time delay differences as a function of spatial location around the head of a listener as shown in FIG. 1.

The time delays for each channel $TD_L$ and $TD_R$ to the left ear and right ear, respectively, are based on the sinewave path lengths from the simulated sound source at left 60° to the left and right ears as shown in FIGS. 3A and 3B. A working value for the speed of sound in normal air is 345 meters per second, which can be used to calculate the effect of a spherical modeled head on interaural time differences. The values for $TD_L$ and $TD_R$ are in themselves less relevant than the path length difference between the two values. Rather than using path lengths to a spherically modeled head as a model, it is also possible to use the calculated mean group delay difference between each channel of a measured binaural head related transfer function. The latter is employed in the subject invention, although either technique, i.e. modeling based on a spherical head or derivation from actual measurements, is adequate for implementing a suitable time delay for each virtual sound position. The mean group delay is calculated within the primary region of energy for speech frequencies such as shown in FIG. 4 in the region 100 Hz–6 kHz for azimuths ranging between 0° and 90°. The "mirror image" can be used for rearward azimuths, for example, the value for 30° azimuth can be used for 150° azimuth. The resulting delay actually used is the "far ear" channel while a value of zero is used in the "near ear" channel.

Accordingly, when $TD_L < TD_R$, as it is for a 60° left virtual source S as shown in FIGS. 3A and 3B, a value for the mean time delay difference in block $\mathbf{30}_1$ for the left ear is set at zero, while for the right ear, the mean time delay difference for a delay equivalent to the difference between $TD_R$ and $TD_L$, is set in block $\mathbf{30}_2$ according to values shown in FIG. 4.

For the other filters $\mathbf{16}_2$, $\mathbf{16}_3$ and $\mathbf{16}_4$ which are used to generate percepts of 150° left, 150° right, and 60° right, the same procedure is followed.

With respect to finite impulse response filters $\mathbf{32}_1$ and $\mathbf{32}_2$ for the 60° left spatial position, each filter is implemented from a set of coefficients obtained from synthetically generated magnitude response curves derived from previously developed HRTF curves made from actual measurements taken for the same location. A typical example involves the filter $\mathbf{16}_1$ shown in FIG. 2, for a virtual source position of 60° left. This involves selecting a predetermined number of points, typically 65, to represent the frequency magnitude response between 0 and 16 kHz of curve $\mathbf{36}_1$ and $\mathbf{36}_2$, with curves $\mathbf{34}_1$ and $\mathbf{34}_2$ as shown in FIGS. 5A and 5B.

The same method is used to derive the synthetic HRTF measurements of the other filter $\mathbf{16}_2$, $\mathbf{16}_3$ and $\mathbf{16}_4$ in FIG. 1. To obtain the 60° right spatial position required for digital filters $\mathbf{16}_4$, for example, the left and right magnitude responses for 60° left as shown in FIGS. 5A and 5B are merely interchanged. To obtain the 150° right position for filter $\mathbf{16}_3$, the left and right magnitude responses for 150° left are interchanged. It should also be noted that the measured HRTF response curves $\mathbf{36}_1$ and $\mathbf{36}_2$ are utilized for illustrative purposes only inasmuch as any measured HRTF can be used, when desired.

The upper limit of the number of coefficients selected for creating a synthetic HRTF is arbitrary; however, the number actually used is dependent upon the upper boundary of the selected DSP's capacity to perform all of the functions necessary in real time. In the subject invention, the number of coefficients selected is dictated by the selection of an interchangeable PROM accessed by a Motorola 56001 DSP operating with a clock frequency of 27 mHz. It should be noted that each of the other digital filters $\mathbf{16}_2$, $\mathbf{16}_3$ and $\mathbf{16}_4$ also include the same DSP-removable PROM chip combinations respectively programmed with individual interaural time delay and magnitude response data in the form of coefficients for the left and right ears, depending upon the spatial position or percept desired, which in this case is 150° left, 150° right and 60° right as shown in FIG. 1. Other positions other than left and right 60° and 150° azimuth, 0° elevation may be desirable. These can be determined through psychoacoustic evaluations for optimizing speech intelligibility, such as taught in D. R. Begault (1993), "Call sign intelligibility improvement using a spatial auditory display" (Technical Memorandum No. 104014), NASA Ames Research Center.

Too few coefficients, e.g. less than 50, result in providing linear phase FIR filters which are unacceptably divergent from originally measured head related transfer functions shown, for example, by the curves $\mathbf{36}_1$ and $\mathbf{36}_2$ in FIGS. 5A and 5B. It is only necessary that the synthetic magnitude response curves $\mathbf{34}_1$ and $\mathbf{34}_2$ closely match those of the corresponding measured head related transfer functions up to 16 kHz, which is to be noted includes within the usable frequency range between 0 Hz and $f_cJ$ (10 kHz). With each digital filter $\mathbf{16}_1$, $\mathbf{16}_2$, $\mathbf{16}_3$ and $\mathbf{16}_4$ being comprised of removable PROMs selectively programmed to store both time delay difference data and finite impulse response filter data, this permits changing of the spatial position for each audio signal by unplugging a particular interchangeable PROM and replacing it with another PROM suitably programmed. This has the advantage over known prior art systems where filtering coefficients and/or delays are obtained from a host computer which is an impractical consideration for many applications, e.g. multiple channel radio communications having different carrier frequencies $f_1 \ldots f_n$. Considering now the method for deriving a synthetic HRTF in accordance with this invention, for example, the curve $\mathbf{34}_1$, from an arbitrary measured HRTF curve $\mathbf{36}_1$, it comprises several steps. First of all, it is necessary to derive the synthetic HRTF so that the number of coefficients is reduced to fit the real time capacity of the DSP chip-PROM combination selected for digital filtering. In addition, the synthetic filter must have a linear phase in order to allow a predictable and constant time shift vs. frequency.

The following procedure demonstrates a preferred method for deriving a synthetic HRTF. First, the measured HRTFs for each ear and each position are first stored within a computer as separate files. Next, a 1024 point Fast Fourier Transform is performed on each file, resulting in an analysis of the magnitude of the HRTFs.

Following this, a weighting value is supplied for each frequency and magnitude derived from the Fast Fourier Transform. The attached Appendix, which forms a part of this specification, provides a typical example of the weights and magnitudes for 65 discrete frequencies. The general scheme is to distribute three weight values across the analyzed frequency range, namely a maximum value of 1000 for frequencies greater than 0 and up to 2250 Hz, an intermediate value of approximately one fifth the maximum value or 200 for frequencies between 2250 and 16,000 Hz, and a minimum value of 1 for frequencies above 16,000 Hz. It will be obvious to one skilled in the art of digital signal processing that the intermediate value weights could be limited to as low as $f_cJ$ and that other variable weighting schemes could be utilized to achieve the same purpose of placing the maximal deviation in an area above $f_cJ$.

Finally, the values of the table shown, for example, in the Appendix are supplied to a well known Parks-McClelland FIR linear phase filter design algorithm. Such an algorithm is disclosed in J. H. McClellend et al (1979) "FIR Linear Phase Filter Design Program", *Programs For Digital Signal Processing*, (pp.5.1-1–5.1-13), New York: IEEE Press and is readily available in several filter design software packages and permits a setting for the number of coefficients used to design a filter having a linear phase response. A Remez exchange program included therein is also utilized to further modify the algorithm such that the supplied weights in the weight column determine the distribution across frequency of the filter error ripple.

The filter design algorithm meets the specification of the columns identified as FREQ, and MAG(dB) most accurately where the weights are the highest. The scheme of the weights given in the weighting step noted above reflects a technique whereby the resulting error is placed above $f_c$, the highest usable frequency of the input, more specifically, the error is placed above the "hard limit" of 16 kHz. The region between $f_cJ$ and 15.5 kHz permits a practical lowpass filter implementation, i.e. an adequate frequency range between the pass band and stop band for the roll offs of the filters $\mathbf{16}_1 \ldots \mathbf{16}_4$ shown in FIG. 1.

Synthetic filters have been designed using the above outlined method and have been compared in a psychoacoustic investigation of multiple subjects who localize speech filtered using such filters and with measured HRTF filters. The results indicated that localization judgments obtained for measured and synthetic HRTFs were found to be substantially identical and reversing channels to obtain, for instance, 60° right and 60° left as described above made no substantial perceptual difference. This has been documented by D. R. Begault in "Perceptual similarity of measured and synthetic HRTF filtered speech stimuli, *Journal of the Acoustical Society of America*, (1992), 92(4), 2334.

The interchangeability of virtual source positional information through the use of interchangeable programmable read only memories (PROMs) obviates the need for a host computer which is normally required in a 3-D auditory display including a random access memory (RAM) which is down-loaded from a disk memory.

Accordingly, thus what has been shown and described is a system of digital filters implemented using selectively interchangeable PROM-DSP chip combinations which generate synthetic head related transfer functions that impose natural cues to spatial hearing on the incoming signals, with a different set of cues being generated for each incoming signal such that each incoming stream is heard at a different location around the head of a user and more particularly one wearing headphones.

Having thus shown and described what is at present considered to be the preferred embodiment and method of the subject invention, it should be noted that the same has been made by way of illustration and not limitation. Accordingly, all modifications, alterations and changes coming within the spirit and scope of the invention as set forth in the appended claims are herein meant to be included.

APPENDIX
SYNTHETIC HRTF MAG. RESPONSE

| | FREQ. | MAG (dB) | WEIGHT |
|---|---|---|---|
| 1 | 0 | 28 | 1000 |
| 2 | 250 | 28 | 1000 |
| 3 | 500 | 28 | 1000 |
| 4 | 750 | 28.3201742 | 1000 |
| 5 | 1000 | 30.7059774 | 1000 |
| 6 | 1250 | 32.7251318 | 1000 |
| 7 | 1500 | 33.7176713 | 1000 |
| 8 | 1750 | 34.9074494 | 1000 |
| 9 | 2000 | 34.8472803 | 1000 |
| 10 | 2250 | 42.8024473 | 200 |
| 11 | 2500 | 45.6278461 | 200 |
| 12 | 2750 | 42.0153019 | 200 |
| 13 | 3000 | 43.1754388 | 200 |
| 14 | 3250 | 44.1976273 | 200 |
| 15 | 3500 | 42.2178506 | 200 |
| 16 | 3750 | 39.4497855 | 200 |
| 17 | 4000 | 33.7393717 | 200 |
| 18 | 4250 | 33.7370408 | 200 |
| 19 | 4500 | 33.3943621 | 200 |
| 20 | 4750 | 33.5929666 | 200 |
| 21 | 5000 | 30.5321917 | 200 |
| 22 | 5250 | 31.8595491 | 200 |
| 23 | 5500 | 30.2365342 | 200 |
| 24 | 5750 | 26.4510162 | 200 |
| 25 | 6000 | 23.6724967 | 200 |
| 26 | 6250 | 25.7711753 | 200 |
| 27 | 6500 | 26.7506029 | 200 |
| 28 | 6750 | 26.7214031 | 200 |
| 29 | 7000 | 25.7476349 | 200 |
| 30 | 7250 | 25.8149831 | 200 |
| 31 | 7500 | 27.7421324 | 200 |
| 32 | 7750 | 28.3414934 | 200 |
| 33 | 8000 | 27.4999637 | 200 |
| 34 | 8250 | 26.0463004 | 200 |
| 35 | 8500 | 20.0270081 | 200 |
| 36 | 8750 | 17.917685 | 200 |
| 37 | 9000 | −3.8442713 | 200 |
| 38 | 9250 | 10.077903 | 200 |
| 39 | 9500 | 16.4291175 | 200 |
| 40 | 9750 | 16.478697 | 200 |
| 41 | 10000 | 15.5998639 | 200 |
| 42 | 10250 | 13.7440975 | 200 |
| 43 | 10500 | 10.9263854 | 200 |
| 44 | 10750 | 9.65579861 | 200 |
| 45 | 11000 | 6.94840601 | 200 |
| 46 | 11250 | 6.51277426 | 200 |
| 47 | 11500 | 5.00407516 | 200 |
| 48 | 11750 | 6.98594207 | 200 |
| 49 | 12000 | 8.66779983 | 200 |
| 50 | 12250 | 8.51948656 | 200 |

-continued

APPENDIX
SYNTHETIC HRTF MAG. RESPONSE

| | FREQ. | MAG (dB) | WEIGHT |
|---|---|---|---|
| 51 | 12500 | 6.05561633 | 200 |
| 52 | 12750 | 3.43263396 | 200 |
| 53 | 13000 | 2.03239314 | 200 |
| 54 | 13250 | 0.67809805 | 200 |
| 55 | 13500 | −1.0820475 | 200 |
| 56 | 13750 | −2.7066935 | 200 |
| 57 | 14000 | −4.3344864 | 200 |
| 58 | 14250 | −3.8335688 | 200 |
| 59 | 14500 | −0.4265746 | 200 |
| 60 | 14750 | 4.19244063 | 200 |
| 61 | 15000 | 7.23285772 | 200 |
| 62 | 15250 | 10.9713699 | 200 |
| 63 | 15500 | 13.8831976 | 200 |
| 64 | 15750 | 16.8619008 | 200 |
| 65 | 16000 | 18.9512811 | 200 |
| 66 | 17000 | 0 | 1 |
| 67 | 20000 | 0 | 1 |
| 68 | 25000 | 0 | 1 |

I claim:

1. A three dimensional audio display system for imposing selectively changeable spatial cues to a plurality of audio signals, comprising:

a respective plurality of parallel audio signal paths for translating said plurality of audio signals and wherein each signal path includes, first filter means having a predetermined filter characteristic and being responsive to one audio signal of said plurality of audio signals, means coupled to said first filter means for converting said one audio signal to a digital audio signal, selectively changeable digital storage means coupled to said converting means and generating first and second digital audio signals in two discrete signal channels from said digital audio signal, each said channel further including means for storing time delay data and means for storing a set of filter coefficients derived from an arbitrary head related transfer function and implementing a synthetic head related transfer function in the form of a linear phase finite impulse response filter which operates to impose spatial cues to said first and second digital audio signals for a predetermined spatial location relative to a listener, means coupled to said digital storage means for converting said first and second digital audio signals to first and second analog audio signals, second filter means having a predetermined filter characteristic coupled to said converting means for filtering said first and second analog audio signals;

first and second circuit means coupled to said second filter means for combining respective first and second analog audio signals and generating therefrom first and second composite first and second audio signals; and transducer means coupled to said first and second composite audio signals for generating a plurality of audio output signals which appear to emanate from selectively predetermined different spatial locations.

2. An apparatus according to claim 1 wherein said storage means comprises an interchangeable programmable read only memory programmed with time delay difference information regarding the difference in time delays for sound to reach the left and right ears of said listener for a preselected spatial location and a set of filter coefficients used to implement finite impulse response filtering over a predetermined audio frequency range.

3. A system according to claim 2 and additionally including a digital signal processing chip coupled to said memory for accessing said interchangeable programmable read only memory.

4. A system according to claim 1 wherein said first and second filter means comprise lowpass filter means having predetermined stopband frequencies.

5. A system according to claim 2 wherein said filter characteristic comprises a lowpass filter characteristic having a stopband frequency set to a predetermined maximum usable frequency.

6. A system according to claim 5 wherein the stopband frequency is set substantially at or below one half the Nyquist rate.

7. A system according to claim 1 wherein said set of filter coefficients result from a filter design procedure for reducing the number of coefficients from an original set of coefficients and where a filter error is placed in a region below the Nyquist rate $F_cN$ but above a predetermined maximum frequency of interest $F_cJ$.

8. A system according to claim 7 wherein said set of filter coefficients have a maximum weighting value for a predetermined low frequency range, an intermediate weighting value lower than said maximum value for a predetermined intermediate frequency range extending up to $F_cJ$ and a minimum weighting value for said predetermined upper frequency range extending up to $F_cN$.

9. A system according to claim 1 wherein said audio signals comprise relatively narrow band audio signals.

10. A system according to claim 1 wherein both said first and second circuit means for combining respective first and second analog audio signals comprise left and right summing networks.

11. A system according to claim 8 and additionally including amplifier means coupled to said left and right summing networks.

12. A system according to claim 9 and wherein said transducer means comprises a pair of headphones.

13. A method for producing a three dimensional audio display imposing selectively changeable spatial cues to a plurality of audio signals, comprising the steps of:

feeding a plurality of analog audio signals outputted from a respective plurality of relatively narrow band audio signals coupled to a respective plurality of parallel signal paths;

lowpass filtering said plurality of analog audio signals;

converting said plurality of analog audio signals to digital audio signals;

converting each of said digital audio signals to first and second digital audio channel signals;

selectively delaying and filtering said first and second digital channel signals by feeding said digital audio channel signals to respective interchangeable circuit means, said circuit means implementing a predetermined time delay and a linear phase finite impulse filter response derived from a synthetic head related transfer function, thereby imposing spatial cues to said first and second digital audio channel signals for a desired spatial location relative to a listener;

converting said digital audio channel signals to first and second analog audio channel signals;

lowpass filtering said first and second analog audio channel signals;

combining respective first and second analog audio channel signals and generating first and second composite first and second audio signals; and coupling said first and second composite second audio signals to transducer means, said transducer means reproducing a plurality of analog audio output signals which appear to emanate from different selectively changeable spatial locations.

14. A method according to claim 13 wherein said interchangeable circuit means comprises a PROM that addresses a digital signal processing chip.

15. A method according to claim 13 wherein said spatial locations include at least 60° left, 150° left, 150° right, and 60° right of the listener and at 0° elevation.

16. A method according to claim 13 wherein said step of delaying comprises delaying one of said digital channel signals by a delay corresponding to time difference for a sound emanating from a predetermined spatial position to reach the left and right ears of the listener.

17. A method according to claim 13 wherein said step of filtering comprises applying a set of stored filter coefficients implementing a finite impulse response over a predetermined audio frequency range to each digital channel signal.

18. A method according to claim 17 wherein said filter coefficients are generated by the further steps of:

storing measured head related transfer functions for a left and a right ear of a listener for each predetermined spatial position required as separate files and computer apparatus;

performing a Fast Fourier Transform on each of said files providing an analysis of the magnitude of the head related transfer functions;

supplying a weighting value to each frequency and magnitude derived from the Fast Fourier Transform;

utilizing the weighting values and designing a finite impulse response linear phase filter to generate a reduced number of coefficients where a filter error is placed in a region below a Nyquist rate $F_cN$ but above a predetermined maximum frequency of interest $F_cJ$.

19. A method according to claim 17 wherein said set of filter coefficients have a maximum weighting value for a predetermined to low frequency range, an intermediate weighting value lower than said maximum value for a predetermined intermediate frequency range extending up to $F_cJ$ and a minimum weighting value for a predetermined upper frequency range extending up to $F_cN$.

20. A method according to claim 13 wherein said audio signals comprise audio signals included in an analog output of a plurality of band limited radio communications signals received on mutually different carrier frequencies.

* * * * *